United States Patent [19]

Schlueter et al.

[11] Patent Number: 4,913,418

[45] Date of Patent: Apr. 3, 1990

[54] SWIM AND EXERCISE PADDLE IMPROVEMENT

[75] Inventors: Nancy J. Schlueter, Phoenix; Ronald L. Johnson, Scottsdale, both of Ariz.

[73] Assignee: Speedshop, Inc., Phoenix, Ariz.

[21] Appl. No.: 276,347

[22] Filed: Nov. 25, 1988

[51] Int. Cl.[4] ..... A63B 31/00; A63B 21/00

[52] U.S. Cl. ..... 272/71; 272/116; 434/254

[58] Field of Search ..... 272/71, 130, 92, 1 B, 272/116; 441/56, 57, 58, 59, 55; 273/29 R, 67 B; 434/254; 128/77, 87 R, 68

[56] References Cited

U.S. PATENT DOCUMENTS

| | | | |
|---|---|---|---|
| 1,558,666 | 10/1925 | Brewer et al. | 273/67 B |
| 2,745,119 | 5/1956 | Whipple | 441/56 |
| 3,397,414 | 8/1968 | Webb | 441/56 |
| 3,765,042 | 10/1973 | Montrella | 441/58 |
| 4,521,011 | 6/1985 | Solloway | 272/116 |
| 4,674,110 | 6/1987 | Eaton et al. | 128/77 |

FOREIGN PATENT DOCUMENTS

| | | | |
|---|---|---|---|
| 969571 | 6/1917 | Canada | 273/60.2 |

*Primary Examiner*—Stephen R. Crow
*Attorney, Agent, or Firm*—Charles E. Cates

[57] ABSTRACT

A swimmer's flexible plastic hand paddle has a surface area larger than a human hand, and a plurality of perforations (approximating the user's hand size) which are positioned to an off-set location on the paddle toward the thumb side of the user's hand. The edge of the paddle closely approaches the outer edge of the user's hand on the thumb side when the hand is in position on the paddle, whereas on the little finger side of the paddle there is a substantially larger (compared to the thumb side of the paddle) area (preferably unperforated) that makes a water foil. The corners of the paddle are rounded and means for attaching the user's hand to the paddle and positioned it in a desired position over the perforations are provided. The thickness in a plastic material having a modulus of elasticity of about 130,000 p.s.i. is from 2 to 4 mm., preferably 3 mm.

15 Claims, 1 Drawing Sheet

FIG. 1
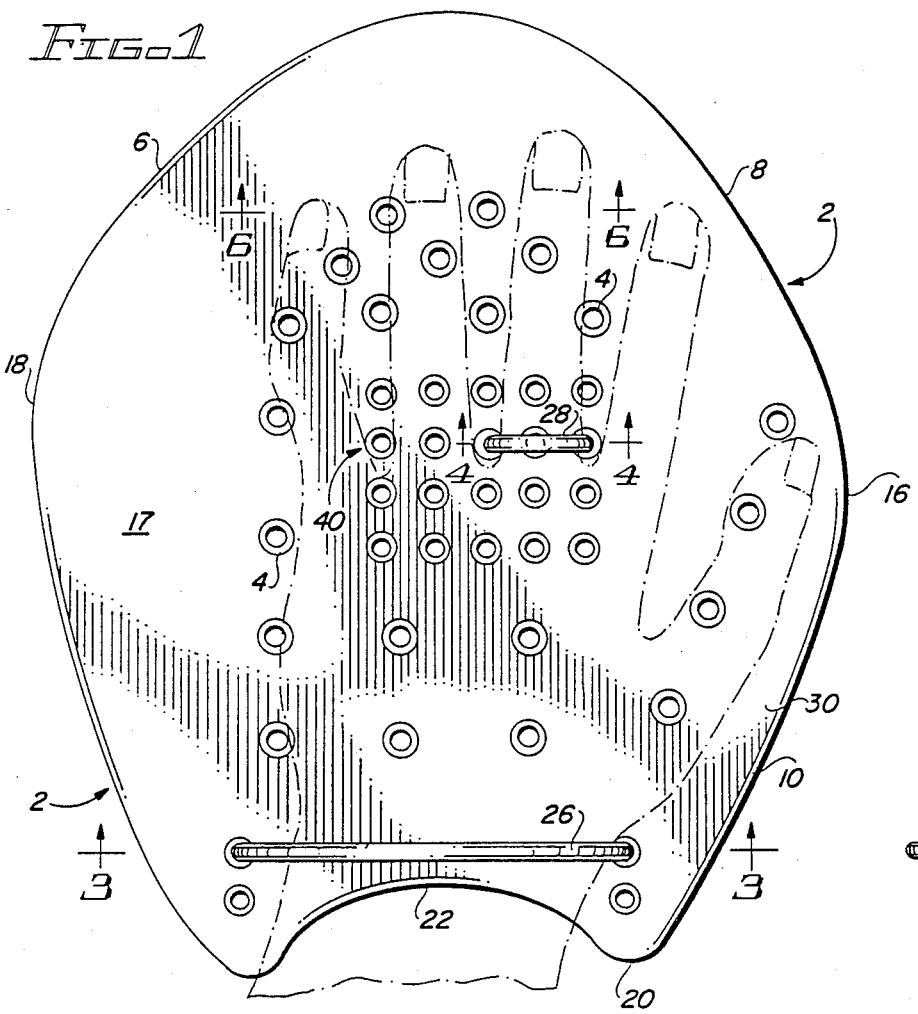
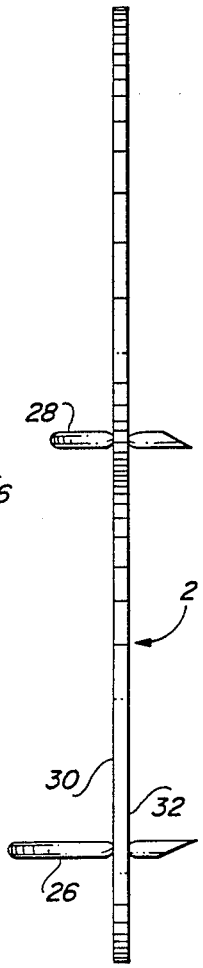
FIG. 2
FIG. 3
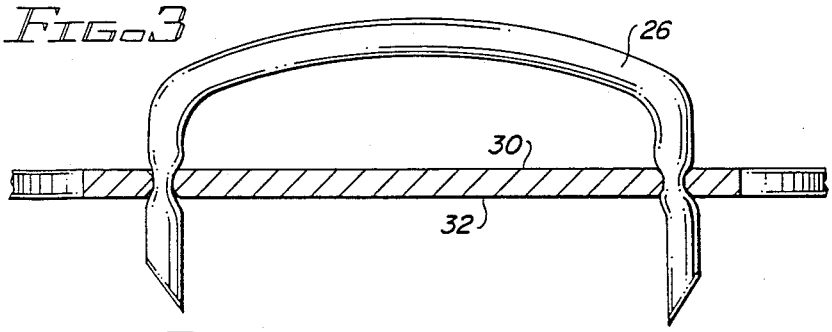
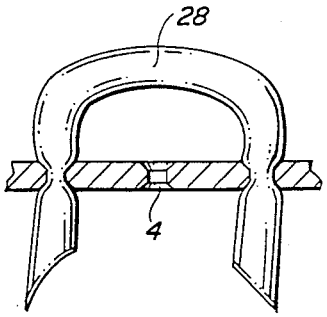
FIG. 4
FIG. 5
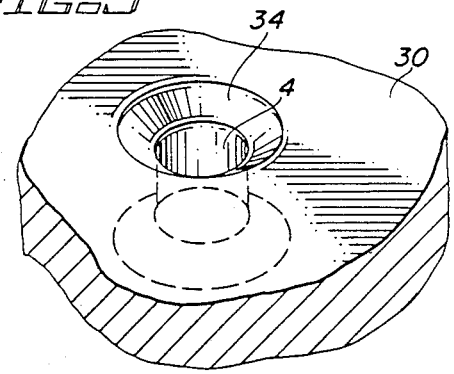
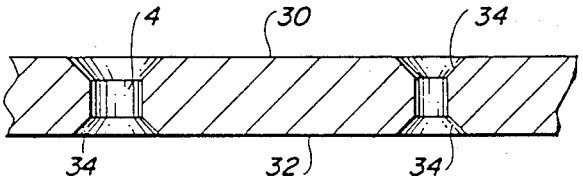
FIG. 6

SWIM AND EXERCISE PADDLE IMPROVEMENT

FIELD OF THE INVENTION

This invention relates to training aids for swimmers, particularly to training paddles such as are used to provide increased resistance to the swimmer's stroking motion for strength building exercises.

THE PRIOR ART

Among the prior art devices known to the inventors are hand size and larger rectangular hand paddles made of solid and rigid plastic material provided with a finger loop and an optional wrist loop for engaging the paddle. This type of paddle exerts damaging stress on the shoulders of the swimmer, particularly the rotator cuff. Another prior art hand-size rectangular paddle is provided with an array of perforations covering essentially the entire surface of the paddle which relieves the stress and gives a more normal "feel" of the water. In yet another prior art solid surface hand-size paddle the corners are rounded. Usually such paddles are provided with finger and wrist loops to secure them to the hands.

BRIEF SUMMARY OF THE INVENTION

The invention hereafter explained in greater detail is a swimmer's flexible plastic hand paddle having a surface area larger than a human hand with a foil that acts like a wing using Bernoüilli's principle. The paddle has a plurality of perforations (approximating the user's hand size) which are in a preferred embodiment positioned to an off-set location on the paddle toward the thumb side of the user's hand. The edge of the paddle closely approaches the outer edge of the user's hand on the thumb side when the hand is in position on the paddle, whereas on the little finger side of the paddle there is a substantial off-set (compared to the thumb side of the paddle) area expanse which provides the foil and which is (in the preferred embodiment) solid disposed to the outside of the perforations. Except in special use, extremely large paddle applications such as aquaerobics and therapeutic paddles, the foil area is unperforated. The corners of the paddle are rounded and means for attaching the user's hand to the paddle and positioning it in a desired position over the perforations are provided. The thickness in a plastic material having a modulus of elasticity of about 130,000 p.s.i. is from 2 to 4 mm., preferably 3 mm.

BRIEF DESCRIPTION OF THE DRAWINGS

In the accompanying drawings which illustrate a presently preferred embodiment of the invention:

FIG. 1 is a plan view of one paddle of a set of two (second not shown), in this case the paddle made for the left hand;

FIG. 2 is an elevation view of the paddle in FIG. 1;

FIG. 3 is an elevation view of the paddle of FIG. 1, in section, taken along the lines 3—3 of FIG. 1;

FIG. 4 is an elevation view of the paddle of FIG. 1, in section, taken along the lines 4—4 of FIG. 1;

FIG. 5 is a perspective view of a perforation in the paddle of FIG. 1, greatly enlarged; and FIG. 6 is a cross section of a fragment of the paddle of FIG. 1, taken along the lines 6—6.

DETAILED DESCRIPTION OF THE INVENTION

A presently preferred embodiment of the invention is shown in the drawings wherein the paddle 2 is cut from a flat sheet of plastic material which is considered flexible compared to prior art paddles which are made of a relatively stiff, unyielding plastic. A preferred plastic material is a polyvinylchloride (sold under the brand name TROVICEL 100) which, in a thickness of about 3 mm, has the desired degree of flexibility.

Although TROVICEL 100 is described in the manufacturer's literature as a free-foamed, rigid PVC foam, it is in fact flexible to the extent required by this invention. It is half the weight of homogeneous rigid PVC sheets, which might account for the additional flexibility. It has low heat conductivity and thus feels sufficiently warm to the user's hand, has low water absorption which is useful in a water device, and absorbs vibration, contributing to the user's sensitivity and precision in use. The latter property is particularly valuable in a new use (in addition to the traditional resistance exercise use) discovered for the swim paddle by the inventors: sculling in synchronized swimming.

The uniform, fine, closed cell structure of the PVC selected facilitates economical working by a wide variety of methods such as cutting, sawing, thermoforming, bending, drilling, punching, embossing, blow moulding, vacuum forming, welding, gluing, screwing, nailing, and riveting. The flexibility of the panel may vary according to the thickness, and the relationships can be selected with reasonable trial. In an especially preferred embodiment of material for use in the invention, the modulus of elasticity is about 130,000 p.s.i.; the tensile strength at yield is 2900 p.s.i.; the elongation at break is 20% and the impact strength is 7 pounds per square inch. A thickness of about 2–4 mm in a material having the foregoing values is the practical range of thickness. An ideal thickness is about 2 to 4 mm.

The paddle is in the form of a rounded lozenge-like shape, or a rectangle whose corners 6, 8, 10 and 12 have been rounded. A plurality of apertures 4 are provided in the paddle 2 and disposed to cover approximately an area on the paddle equal to the hand size (shown in broken lines) of the user. To accommodate varying hand sizes a range of paddle sizes are provided.

It is a feature of the invention that the apertures 4 in the paddle 2 closely approach the edge of the paddle on the thumb side 16 while leaving a substantially larger unperforated area 17 on the foil side 18 of the paddle. This has been found particularly useful in sculling, a new use for the paddle in certain specialized types of swimming such as are referred to above. In a larger application it provides, in conjunction with other unperforated areas of the paddle, the required resistance for training without putting the harmful stress on the rotator cuff that is characteristic of essentially solid prior art paddles.

The distribution of the apertures 4 is a flexible requirement, and once the teaching of this disclosure is appreciated, persons ordinarily skilled in the art may vary the number and location of the apertures to adjust to the conditions of use, bearing in mind that the pattern of aperture distribution should approximate the area of the user's hand to provide a feel for the water and should be disposed well to the thumb side 16 of the paddle. The number of apertures within the pattern of distribution may be varied to adjust the degree of resistance provided by the paddle. A small grid 40, which can take other shapes, is provided at approximately the place where the base of the user's fingers would lie on the paddle. Each paddle size is adjustable within limits to the hand sizes of many users, and the grid 40 provides closely spaced apertures specifically for the purpose of making an adjustment to both user hand size and idiosyncratic shape and desired position of the hand on the paddle to provide adaptability to differing purposes of use.

Rubber tubing 26 is pulled through the apertures 4, as is known in the art, to secure the paddle to the hand of the user at the wrist and a finger, usually the middle finger. The position of the user's hand on the paddle may be varied by changing the apertures engaged by the tubing as desired.

Preferably, the apertures 4 are finished at the paddle surface areas 30, 32 with bevelled edges 34, for appearance and to avoid damage to the tubing caused by sharp edges.

EXAMPLE 1

A pair of paddles were made out of TROVICEL ® 100 PVC rigid foam sheets in a thickness of 3 mm, 8¼" long and 7" wide. A solid water foil area 17 approximately 1¾" wide at the widest point was provided. The remaining area was provided with 38 apertures including a grid 40 of 16 apertures distributed as shown in the drawing and 4 apertures for engagement of a wrist loop tubing 26.

EXAMPLE 2

A pair of paddles were made out of TROVICEL ® 100 PVC rigid foam sheets in a width of 3 mm, 9" long and 7¾" wide. A solid water foil area 17 approximately 2" at the widest point was provided. The remaining area was provided with 42 apertures including a grid 40 of 20 apertures distributed as shown in the drawing.

EXAMPLE 3

A pair of paddles were made out of TROVICEL ® 100 PVC rigid foam sheets in a width of 3 mm, 9½" long and 8¼" wide. A solid water foil area approximately 2¼" by at the widest point was provided. The remaining area was provided with 45 apertures including a grid 40 of 20 apertures distributed as shown in the drawing.

EXAMPLES 3

A pair of paddles were made out of TOVICEL ® 100 PVC rigid foam sheets in a width of 3 mm, 10½" long and 8¾" wide. A solid water foil area 17 approximately 2½" at the widest point was provided. The remaining area was provided with 45 apertures including a grid 40 of 20 apertures distributed as shown in the drawing.

In addition to the traditional uses for which prior art paddles were employed, the paddles of this invention are useful for synchronized swimming, surfing, triathlon, masters competition, long distance swimming, lessons, medical rehabilitation, general recreation and water exercises in general. The paddles are helpful in teaching and learning proper stroke techniques because the user can feel the stroke better and the coach can see the stroke better. Both the size and the color of the paddle contribute to this advantage. Moreover, the paddle urges the user to follow through at the end of the stroke because the resistance of the paddle both reminds and impedes early recovery. Another advantage is that the paddle teaches streamlining when pushing off the pool wall. If the swimmer's arms are not together the paddles pull them apart. The paddles also facilitate learning the proper hip turn in free style. The paddles make it impossible to avoid hitting the thighs if the hips are not turned properly.

It is to be understood that the paddles are used in pairs and that a second paddle for the opposite hand is provided in the set and is the mirror image of the first. For convenience, only one of the two paddles is shown in the drawing. While an exemplary embodiment of the invention is disclosed in this specification, it will be appreciated by those skilled in the art that equivalent structures and values may be used which do not depart from the spirit and scope of the invention and its disclosure herein and are comprehended by the appended claims.

What is claimed is:

1. A swimmer's hand paddle comprising:

(a) a surface area substantially wider than the user's hand;

(b) means defining, by the orientation of the user's hand on said surface area, a thumb side of said area and a little finger side of said area;

(c) a perforated paddle section comprising a plurality of perforations on said surface area, approximately the size of the user's hand, displaced to the edge of said surface area on said thumb side;

(d) means for attaching the user's hand to the paddle over the area of said perforations, said attaching means positionally adjustable on said plurality of perforations whereby the user's hand feels the flow of the water through said perforations, and the unperforated surface area provides a foil in the little finger side of the paddle.

2. The paddle of claim 1 wherein at least one corner on said little finger side is rounded.

3. The paddle of claim 1 comprising color added to the paddle.

4. The paddle of claim 2 comprising color added to the paddle.

5. The paddle of claim 1 comprising a thickness of about 2–4 mm and a modulus of elasticity of about 130,000 psi.

6. The paddle of claim 2 comprising a thickness of about 2–4 mm and a modulus of elasticity of about 130,000 psi.

7. The paddle of claim 3 comprising a thickness of about 2–4 mm and a modulus of elasticity of about 130,000 psi.

8. The paddle of claim 4 comprising a thickness of about 2–4 mm and a modulus of elasticity of about 130,000 psi.

9. The paddle of claim 1 wherein said perforations comprise a closely spaced array in the paddle area approximating the location of the base of the fingers.

10. The paddle of claim 2 wherein said perforations comprise a closely spaced array in the paddle area approximating the location of the base of the fingers.

11. The paddle of claim 3 wherein said perforations are closely spaced array in the paddle area approximating the location of the base of the fingers.

12. The paddle of claim 4 wherein said perforations comprise a closely spaced array in the paddle area approximating the location of the base of the fingers.

13. The paddle of claim 5 wherein said perforations comprise a closely spaced array in the paddle area approximating the location of the base of the fingers.

14. The paddle of claim 6 wherein said perforations comprise a closely spaced array in the paddle area approximating the location of the base of the fingers.

15. The paddle of claim 7 wherein said perforations comprise a closely spaced array in the paddle area approximating the location of the base of the fingers.

* * * * *

UNITED STATES PATENT AND TRADEMARK OFFICE

CERTIFICATE OF CORRECTION

PATENT NO. : 4,913,418

DATED : April 3, 1990

INVENTOR(S) : Nancy J. Schlueter; Ronald L. Johnson

It is certified that error appears in the above-identified patent and that said Letters Patent is hereby corrected as shown below:

In Claim 1, section (d), line 36, "in" should be --on--.

Signed and Sealed this

Seventeenth Day of September, 1991

*Attest:*

HARRY F. MANBECK, JR.

*Attesting Officer*

*Commissioner of Patents and Trademarks*